US009613594B2

(12) United States Patent
Yang et al.

(10) Patent No.: US 9,613,594 B2
(45) Date of Patent: Apr. 4, 2017

(54) DRIVING CIRCUIT AND DRIVING METHOD FOR A DISPLAY DEVICE

(71) Applicants: Xiamen Tianma Micro-Electronics Co., Ltd., Xiamen (CN); Tianma Micro-Electronics Co., Ltd., Shenzhen (CN)

(72) Inventors: Jinjin Yang, Xiamen (CN); Qingjun Lai, Xiamen (CN)

(73) Assignees: XIAMEN TIANMA MICRO-ELECTRONICS CO., LTD., Xiamen (CN); TIANMA MICRO-ELECTRONICS CO., LTD., Shenzhen (CN)

( * ) Notice: Subject to any disclaimer, the term of this patent is extended or adjusted under 35 U.S.C. 154(b) by 25 days.

(21) Appl. No.: 14/577,114

(22) Filed: Dec. 19, 2014

(65) Prior Publication Data

US 2015/0187336 A1 Jul. 2, 2015

(30) Foreign Application Priority Data

Dec. 31, 2013 (CN) ..... 2013 1 0754285

(51) Int. Cl.
*G09G 3/20* (2006.01)
*G09G 5/18* (2006.01)

(52) U.S. Cl.
CPC ..... *G09G 5/18* (2013.01); *G09G 3/20* (2013.01); *G09G 2310/0275* (2013.01); *G09G 2330/06* (2013.01); *G09G 2370/08* (2013.01)

(58) Field of Classification Search
CPC ..... G09G 3/20; G09G 3/3685–3/3688; G09G 5/18; G09G 2310/0264–2310/0297; G09G 2330/06; G09G 2370/08
USPC ..... 345/99–100
See application file for complete search history.

(56) References Cited

U.S. PATENT DOCUMENTS 5,617,111 A * 4/1997 Saitoh ..... G09G 3/2011 345/100
2009/0128533 A1* 5/2009 Tsubata ..... G02F 1/13624 345/209
2010/0164929 A1* 7/2010 Chen ..... G09G 3/3688 345/211
2011/0148852 A1* 6/2011 Kim ..... G09G 3/20 345/213
2012/0146967 A1* 6/2012 Kim ..... G09G 3/3688 345/204

FOREIGN PATENT DOCUMENTS

CN 101377911 A 3/2009
CN 102237030 A 11/2011

* cited by examiner

*Primary Examiner* — Michael Pervan
(74) *Attorney, Agent, or Firm* — Anova Law Group, PLLC

(57) ABSTRACT

A driving circuit includes first and second source driving circuits, and first and second control units. Each of the first and second control units includes multiple first control subunits. Each of the first control subunits includes a control end, an input end, and an output end. The control end receives a control signal to turn on or off the first control subunit. The input end receives a clock signal. The output end is connected with the associated source driving circuit. The first and second control units enable switching between the unilateral driving mode and the bilateral driving mode for the clock signal.

11 Claims, 10 Drawing Sheets

DRIVING CIRCUIT AND DRIVING METHOD FOR A DISPLAY DEVICE

CROSS-REFERENCES TO RELATED APPLICATIONS

This application claims the benefit of priority to Chinese Patent Application No. 201310754285.3, filed with the Chinese Patent Office on Dec. 31, 2013 and entitled "DRIVING CIRCUIT AND DRIVING METHOD FOR A DISPLAY DEVICE" the content of which is incorporated herein by reference in its entirety.

BACKGROUND OF THE INVENTION

With the rapid development of display devices, the quality requirement of images shown by the display devices is increasing gradually. Electromagnetic Interference (EMI) existing in the display devices is a critical factor affecting the quality of the images shown by the display devices. However, the value of electromagnetic interference is closely associated with driving methods for the display devices. In this way, the driving methods for the display devices are believed to be a critical factor affecting the quality of images.

FIG. 1 is a schematic view showing a circuit of a bilateral-driven display device in the related art. FIG. 2 is a schematic view of a driving circuit in the bilateral-driven display device in the related art. As shown in FIG. 1, the bilateral-driven display device includes a timing driving circuit 11, a gate driving circuit (not shown), a first source driving circuit 17 comprising a first transistor unit 13, a second source driving circuit 19 comprising a second transistor unit 15, and a display device 16. As shown in FIG. 2, each of the first transistor unit 13 and the second transistor unit 15 includes three transistor subunits, a gate of each of the transistor subunits is respectively connected with the timing driving circuit 11 to receive a clock signal, a source of each of the transistor subunits is respectively connected with a source driving signal line 120 to receive a source driving signal for the transistor in a pixel unit, and a drain of each of the transistor subunits is respectively connected with a source of the transistor in the corresponding pixel unit to control the corresponding pixel unit.

In this way, as shown in FIG. 1, in the driving circuit of the related art, the clock signal is applied to the first source driving circuit 17 by the first transistor unit 13 and the clock signal is applied to the second source driving circuit 19 by the second transistor unit 15. In this way, the same clock signal can be applied to each column of pixel units through the first source driving circuit 17 and the second source driving circuit 19 respectively and thereby the bilateral driving method for each column of pixel unit in the display device 16 is realized. However, as bilateral driving method for the clock signal will cause the display device to have a higher value of electromagnetic interference as compared to unilateral driving method for the clock signal, the bilateral driving method for the clock signal would degrade the image quality of the display device more than the unilateral driving method for the clock signal.

DETAILED DESCRIPTION OF THE INVENTION

Figure 1:
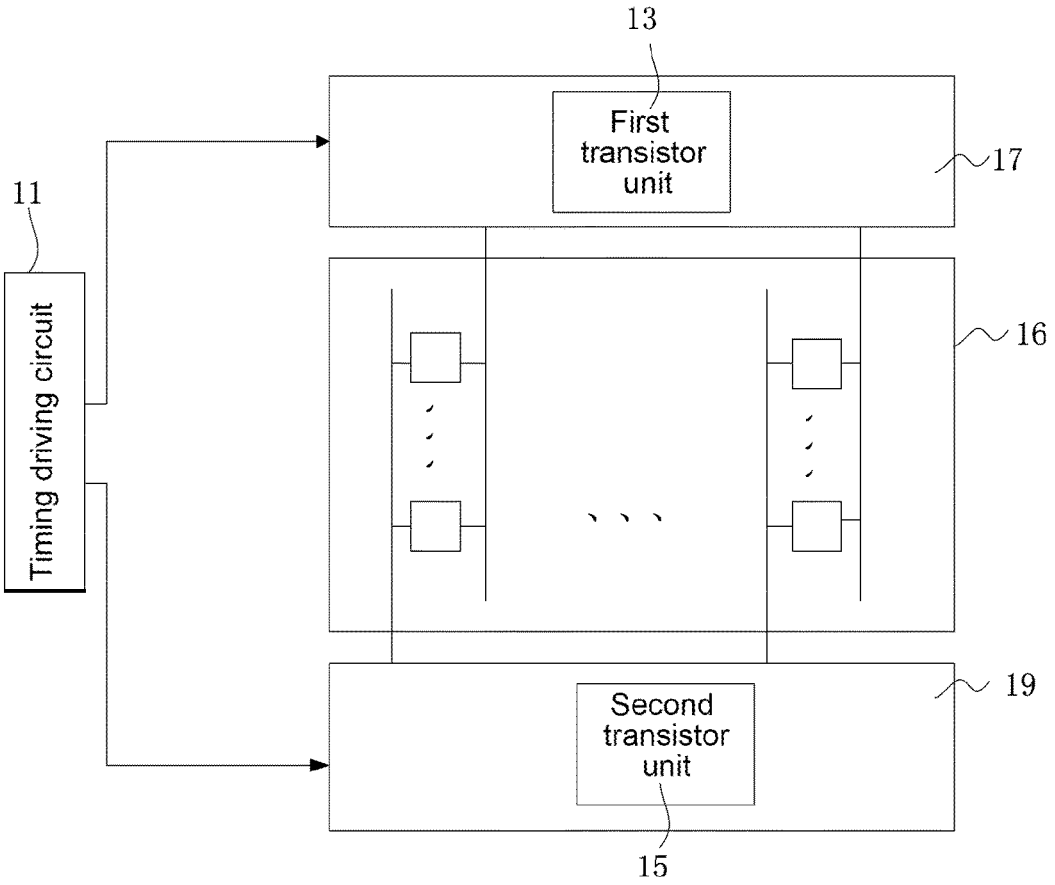
FIG. 1 is a schematic view showing a circuit of a bilateral-driven display device in the related art.
Figure 2:
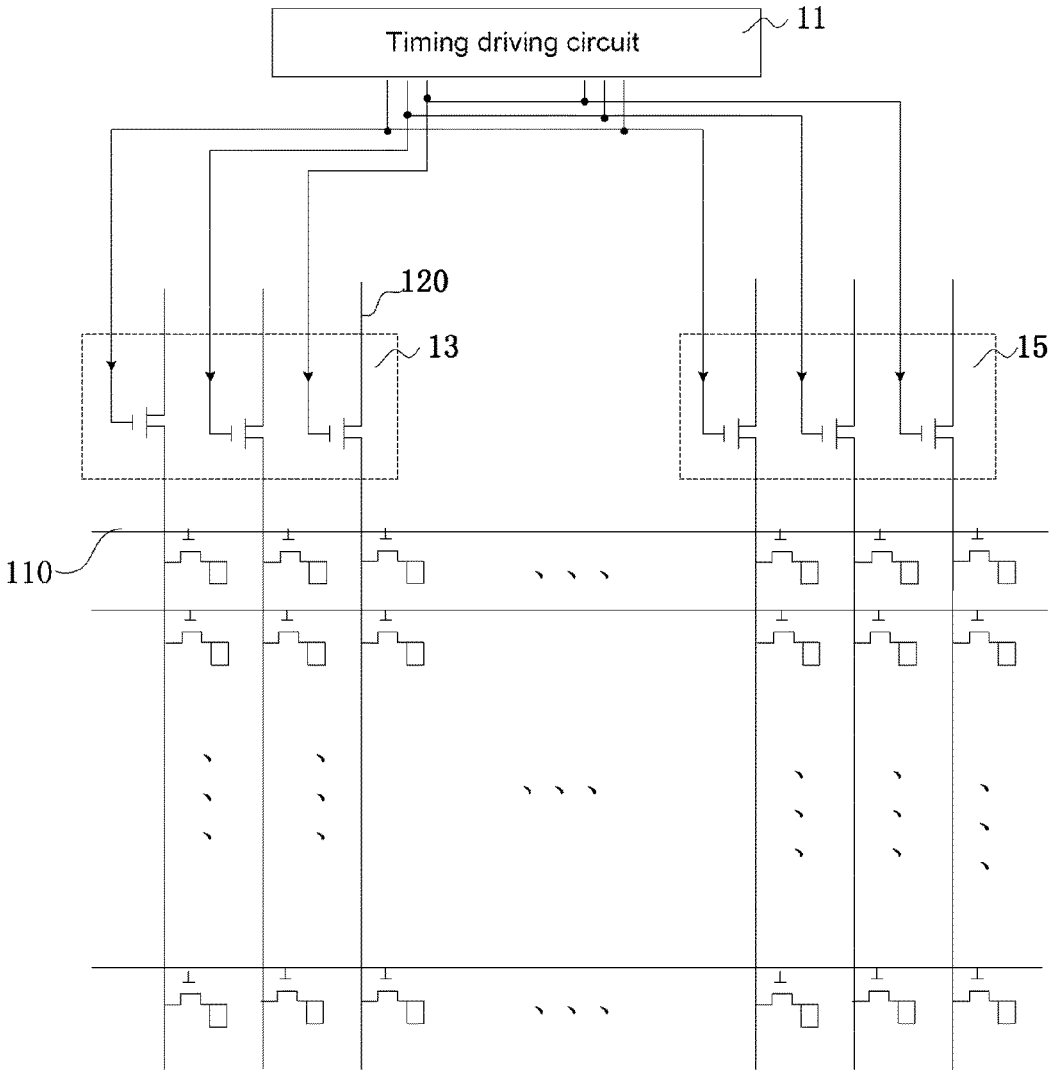
FIG. 2 is a schematic view showing a driving circuit in the bilateral-driven display device in the related art.

The present disclosure is described in detail in conjunction with the embodiments and the accompanying drawings. It should be understood that the embodiments described herein are only used to explain the present disclosure, and not to limit the present disclosure. Moreover, it is also noted that only relevant portions associated with the present disclosure and not all portions of the present disclosure are shown in the drawings for purposes of clarity.

Figure 3:
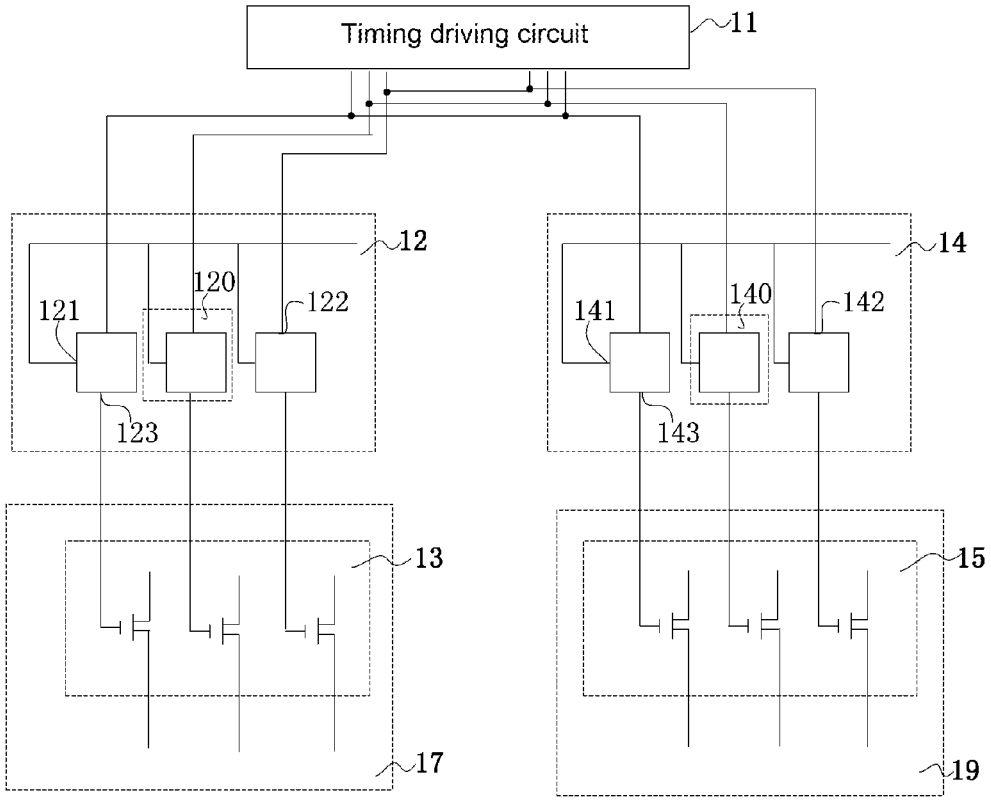
FIG. 3 is a driving circuit schematic diagram of a display device according to an embodiment of the present disclosure.

FIG. 3 shows a driving circuit of a display device according to an embodiment of the present disclosure. As shown in FIG. 3, the driving circuit of the present embodiment includes a first source driving circuit 17, a second source driving circuit 19, a first control unit 12, and a second control unit 14, wherein the first source driving circuit 17 includes a first transistor unit 13, and the second source driving circuit 19 includes a second transistor unit 15. The first control unit 12 includes a plurality of first control subunits 120, with each of the first control subunits 120 including a control end 121, an input end 122 and an output end 123. Each control end 121 of the first control subunits 120 is configured to receive a first control signal to turn on or off the first control subunits 120, each input end 122 of the first control subunits 120 is configured to receive a clock signal, and each output end 123 of the first control subunits 120 is connected with the first source driving circuit 17. The second control unit 14 includes a plurality of second control subunits 140, each of the second control subunits 140 including a control end 141, an input end 142 and an output end 143. Each control end 141 of the second control subunits 140 is configured to receive a second control signal to turn on or off of the second control subunits 140, each input end 142 of the second control subunit 140 is configured to receive the clock signal, and each output end 143 of the second control subunits 140 is connected with the second source driving circuit 19.

The first source driving circuit 17 includes a first transistor unit 13 including a plurality of transistors, wherein a drain of each transistor of the first transistor unit 13 is connected to a source of a transistor of a corresponding pixel unit, a source of each transistor of the first transistor unit 13 is configured to receive a source driving signal for the transistor of the pixel unit, and a gate of each transistor of the first transistor unit 13 is configured to receive a clock signal for driving pixel unit of a single color from an output end of a corresponding control subunit. The second source driving circuit 19 includes a second transistor unit 15 including a plurality of transistors, wherein a drain of each transistor of the second transistor unit 15 is connected to a source of a transistor of a corresponding pixel unit, a source of each transistor of the second transistor unit 15 is configured to receive a source driving signal for the transistor of the pixel unit and a gate of each transistor of the second transistor unit 15 is configured to receive a clock signal for driving pixel unit of a single color from an output end of a corresponding control subunit. The number of the transistors in the first transistor unit 13 or the second transistor unit 15 is the same as the number of the columns of sub-pixel units in the display device. For example, in the case that the display device has 720 columns and each pixel is formed by a red sub-pixel, a green sub-pixel and a blue sub-pixel, then there will be 2160 transistors in each of the first transistor unit 13 and the second transistor unit 15.

Alternatively, the first control unit 12 has three control subunits for controlling the transmission of the clock signal of a first pixel, the clock signal of a second pixel and the clock signal of a third pixel respectively, for example, for controlling the transmission of the clock signal of a red pixel, the clock signal of a green pixel and the clock signal of a blue pixel. That is, the control subunit corresponding to the red pixel in the first control unit 12 controls all columns of red pixels in the display device, the control subunit corresponding to the green pixel in the first control unit 12 controls all columns of green pixel in the display device and the control subunit corresponding to the blue pixel in the first control unit 12 controls all columns of blue pixel in the display device. Accordingly, the second control unit 14 also has three control subunits for controlling the transmission of the clock signal of the first pixel, the clock signal of the second pixel and the clock signal of the third pixel respectively. Alternatively, each of the first control unit 12 and the second control unit 14 can have four control subunits for controlling the transmission of the clock signal of the first pixel, the clock signal of the second pixel, the clock signal of the third pixel and the clock signal of the fourth pixel respectively, for example, for controlling the transmission of the clock signal of the red pixel, the clock signal of the green pixel, the clock signal of the blue pixel and the clock signal of the yellow pixel respectively. The number of the control subunits is not limited in the embodiment as long as the pixels in the display device can be driven.

Each of control ends 121 of the first control subunits 120 receives the first control signal to turn on or off the first control unit 12 and each input end 122 of the first control subunits 120 is connected to a timing driving circuit 11 to receive the clock signal. Each of control ends 141 of the second control units 140 receives the second control signal to turn on or off the second control unit 14 and each input end 142 of the second control units 140 is connected to the timing driving circuit 11 to receive the clock signal. Each of the output ends 123 of the first control subunit 120 and the output ends 143 of the second control subunit 140 is connected with a respective gate of the transistor of the corresponding pixel unit, and control ends 121 of the plurality of first control subunit 120 are electrically connected with each other, the control ends 141 of plurality of the second control subunit 140 are also electrically connected with each other. That is, each of the control ends 121 of the first control subunits 120 of the first control unit 12 receives a first control signal and each of the control ends 141 of the second control subunits 140 of the second control unit 14 receives a second control signal. Alternatively, the clock signal is a high-level clock signal CKH which is provided by the timing driving circuit 11.

In the driving circuit of the embodiment of the present disclosure, the first control unit 12 receives the first control signal through the control end 121 to turn on or off the first control unit 12 and the second control unit 14 receives the second control signal through the control end 141 to turn on or off the second control unit 14. When each control subunit of the first control unit 12 and the second control unit 14 is turned on, the display device is driven by the clock signal in a bilateral driving method in the driving circuit of the embodiment of the present disclosure. When one control subunit of the first control unit 12 and the second control unit 14 is turned on and the other control subunit is turned off, the display device is driven by the clock signal in an unilateral driving method. In this way, the driving circuit according to the embodiments of the present disclosure enables switching between a unilateral driving method and a bilateral driving method of the clock signal for the display device by the first control signal and the second control signal.

Figure 4:
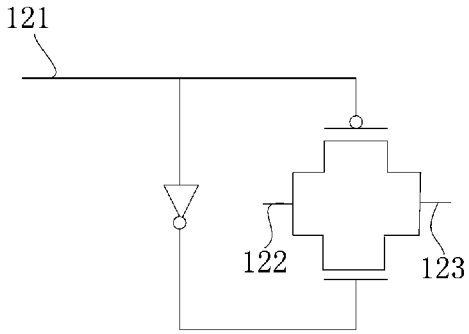
FIG. 4 is a circuit schematic diagram of a control subunit according to an embodiment of the present disclosure.
Figure 5:
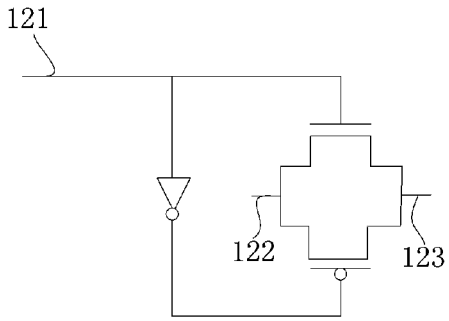
FIG. 5 is a circuit schematic diagram of the control subunit according to an embodiment of the present disclosure.

As each of the control subunits of the two control units in the driving circuit in the embodiment is configured to turn on or off the driving circuit, each of the control subunits can be a diode, a transistor, and a transfer gate, etc. The specific form of the control subunit is not defined in the embodiment as long as the control subunit can be used to turn on or off the driving circuit. Alternatively, the control subunit includes a transfer gate and an inverter. FIG. 4 and FIG. 5 are circuit diagrams of the control subunit according to an embodiment of the present disclosure. As shown in FIG. 4 and FIG. 5, the transfer gate is a complementary metal oxide semiconductor formed by a P-type thin film field effect transistor and a N-type thin film field effect transistor switched in parallel, wherein an input end 122 of the first control subunit 120 is electrically connected with both a source of the N-type thin film field effect transistor and a drain of the P-type thin film field effect transistor, and an output end 123 of the control subunit 120 is electrically connected with both a drain of the N-type thin film field effect transistor and a source of the P-type thin film field effect transistor. As shown in FIG. 4, alternatively, a gate of the P-type thin film field effect transistor is configured to directly receive the control signal, an input end of the inverter is configured to receive the control signal and an output end of the inverter is connected to the gate of the N-type thin film field effect transistor. As shown in FIG. 5, alternatively, the gate of the N-type thin film field effect transistor is configured to directly receive the control signal, the input end of the inverter is configured to receive the control signal and the output end of the inverter is connected to the gate of the P-type thin film field effect transistor. The circuit connection in the second control subunit 140 is the same as that in the first control subunit 120 as described above and will not be described in detail herein.

Alternatively, the display device also includes an external flexible circuit board. The control ends 121 of the plurality of control subunits 120 of the first control unit 12 are connected with a first control signal line disposed on the external flexible circuit board and the control ends 141 of the plurality of control subunits of the second control unit 14 are connected with a second control signal line disposed on the external flexible circuit board. The first control signal line and the second control signal line individually receive the control signal respectively. As the first control signal line connected with each of control ends 121 of the plurality of control subunits 120 of the control unit 12 is provided on the external flexible circuit board, the first control unit 12 can be turned on or off easily and conveniently by the external flexible circuit board, such that the first source driving circuit 17 is turned on or off. Correspondingly, as the second control signal line connected with each of control ends 141 of the plurality of control subunits 140 of the control unit 14 is also provided on the external flexible circuit board, the second source driving circuit 19 can also be turned on or off by the external flexible circuit board. As such, the driving of each of the pixels in the display device by the clock signal in the unilateral driving method or in the bilateral driving method can be controlled easily and conveniently through the external flexible circuit board. After the masking design of the display device has been contracted to be manufactured, if the driving method of the CKH for the display device needs to be switched to reduce the value of electromagnetic interference, it can be realized by providing the first control signal line and the second control signal line on the external flexible circuit board, thereby reducing the cost of switching between unilateral driving and bilateral driving for the CHK and improving the working efficiency.

The two control units and the two transistor units are used to connect with the timing driving circuit and the two source driving circuits in present embodiment, such that the display device is driven by the CKH signal in the unilateral driving method or in the bilateral driving method. The control units and the transistor units are both disposed in non-display region of the display device.

Figure 6:
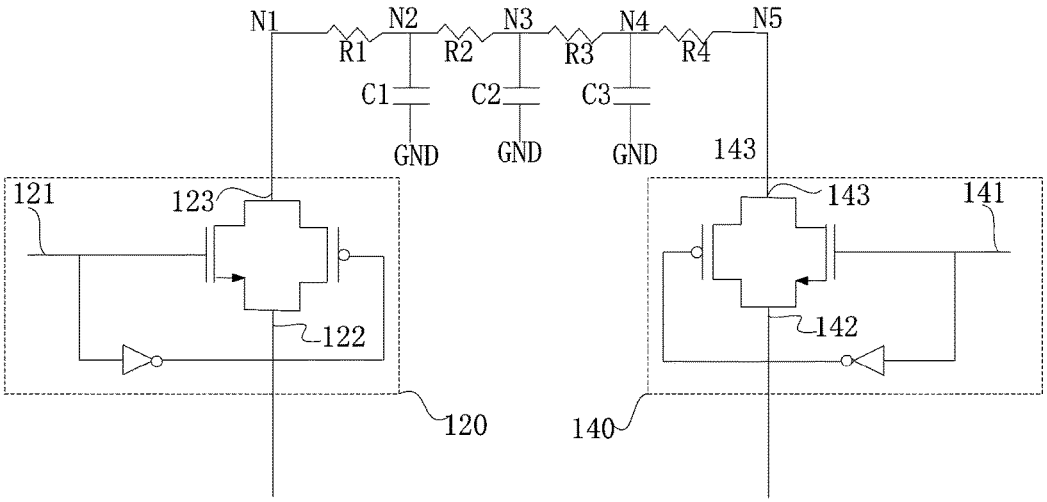
FIG. 6 is a circuit schematic diagram showing a switched driving circuit according to an embodiment of the present disclosure

FIG. 6 is a circuit diagram showing a switched driving circuit according to an embodiment of the present disclosure. As shown in FIG. 6, a switched driving circuit includes a first control subunit 120, a second control subunit 140, resistors R1 to R4 and capacitors C1 to C3, wherein an output end 123 of the first control subunit 120, resistor R1, resistor R2, resistor R3 and resistor R4 are connected with an output end 143 of the second control subunit 140 in series. Resistors R1, R2 and R3 are electrically connected with one end of the capacitors C1, C2 and C3 through nodes N2, N3 and N4 respectively, the other end of each of the capacitances is grounded, and each of the resistors has a resistance of about 1000 Ohm and each of the capacitors has a capacitance of about 200 pF. Each of the first control subunit 120 and the second control subunit 140 includes a transfer gate and an inverter. The transfer gate is formed of a P-type thin film field effect transistor and a N-type thin film field effect transistor, wherein an input end of the first control subunit 120 is electrically connected with both a source of the N-type thin film field effect transistor and a drain of the P-type thin film field effect transistor, and the output end of the first control subunit 120 is electrically connected with both a drain of the N-type thin film field effect transistor and a source of the P-type thin film field effect transistor; an input end of the second control subunit 140 is electrically connected with both the source of the N-type thin film field effect transistor and the drain of the P-type thin film field effect transistor, and the output end of the second control subunit 140 is electrically connected with both the drain of the N-type thin film field effect transistor and the source of the P-type thin film field effect transistor. An input end of the inverter is connected with a gate of the P-type thin film field effect transistor so as to be functioned as a control end of the control subunit. An output end of the inverter is connected with the gate of the N-type thin film field effect transistor. Each of FIGS. 7A to 7C, FIGS. 8A to 8C and FIGS. 9A to 9C shows the graph of the clock signal of the switched driving circuit in FIG. 6, with the time on the horizontal abscissa and the voltage magnitude of the clock signal on the vertical ordinate.

Figure 7A:
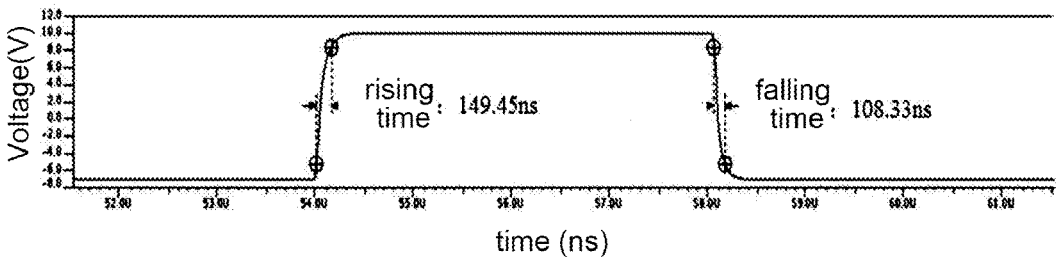
FIGS. 7A to 7C show the clock signal at nodes N1, N3 and N5 respectively according to an embodiment of the present disclosure.
Figure 7B:
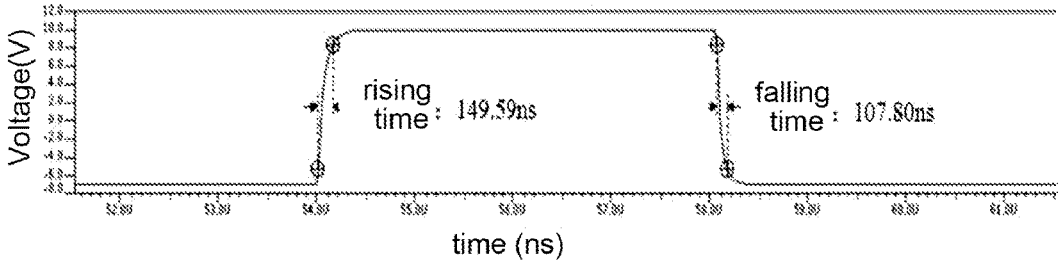
Figure 7C:
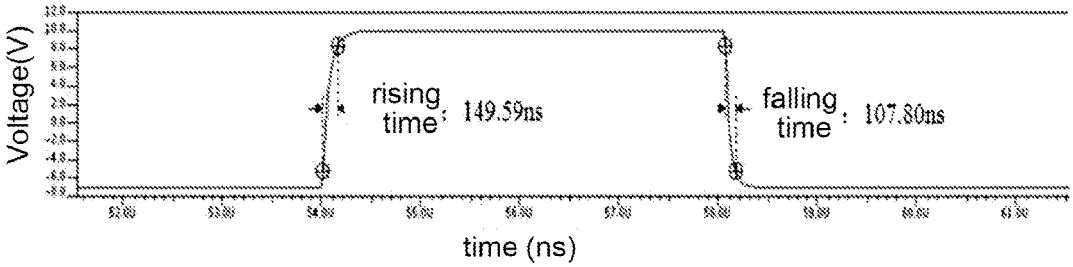

FIGS. 7A to 7C show graphs of the amplitudes of the clock signal at nodeN1, nodeN3 and nodeN5 respectively according to an embodiment of the present disclosure. In this case, each of the control ends 121 of the first control subunit 120 and each of the control ends 141 of the second control subunit 140 receives a high-level signal, i.e., the driving method for the driving circuit in FIGS. 7A to 7C is a bilateral driving method. As can be seen from FIGS. 7A to 7C, when the driving method for the driving circuit is a bilateral driving method, the delayed values of the clock signal at nodes N1, N3 and N5 are approximately the same, i.e., with a rise time of about 150 ns and a fall time of about 108 ns, in this way horizontal lateral crosstalk can be avoided.

Figure 8A:
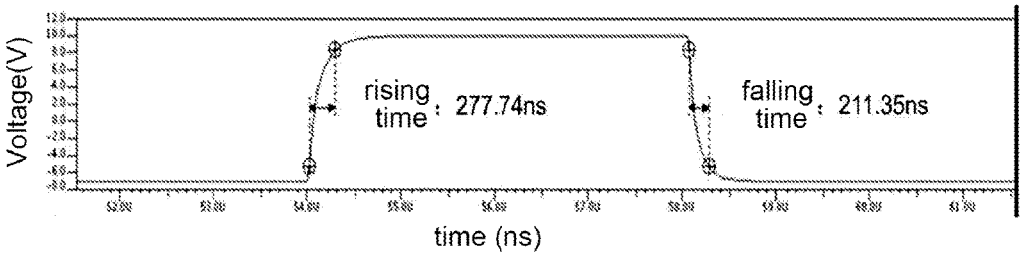
FIGS. 8A to 8C show the clock signal at the nodes N1, N3 and N5 respectively according to an embodiment of the present disclosure.
Figure 8B:
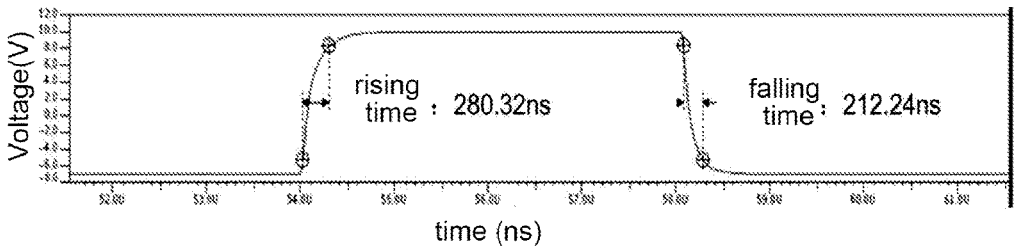
Figure 8C:
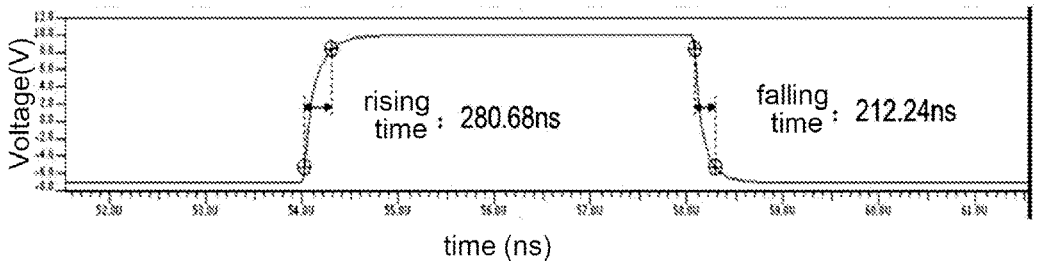

FIGS. 8A to 8C show graphs of the amplitudes of the clock signal at node N1, node N3 and node N5 respectively according to an embodiment of the present disclosure. In this case, the control end 121 of the first control subunit 120 receives a high-level signal and the control end 141 of the second control subunit 140 receives a low-level signal ,i.e., the driving method for the driving circuits in FIGS. 8A to 8C is a unilateral driving method. As can be seen from FIGS. 8A to 8C, when the driving method for the driving circuit is the unilateral driving method, the delayed values of the clock signal at nodes N1, N3 and N5 are also the same, i.e., the rise time of about 280 ns and the fall time of about 212 ns, which are larger than those in FIGS. 7A to 7C.

As can be seen in FIGS. 7A to 7C and FIGS. 8A to 8C, the transition time values of the clock signal at each node in series are the same regardless of whether the driving circuit is driven in the unilateral driving method or the bilateral driving method, i.e., the transition time value of the clock signal at each endpoint in FIG. 6 can embody the transition time value of the clock signal in the driving circuit.

Figure 9A:
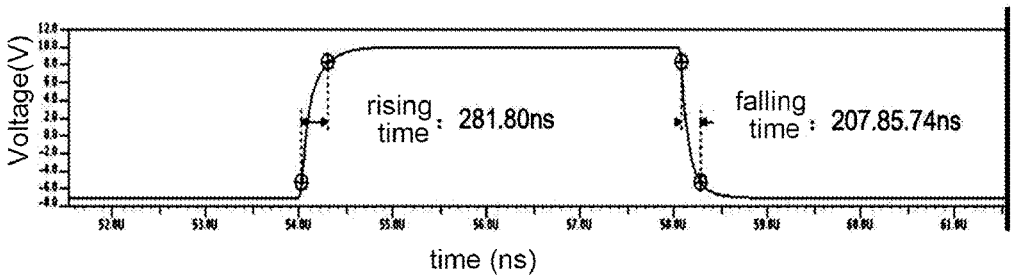
FIGS. 9A to 9C show delayed values of the clock signal at node N3 according to an embodiment of the present disclosure.
Figure 9B:
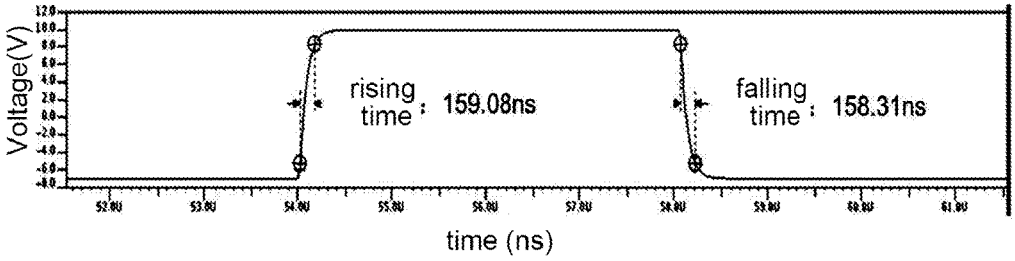
Figure 9C:
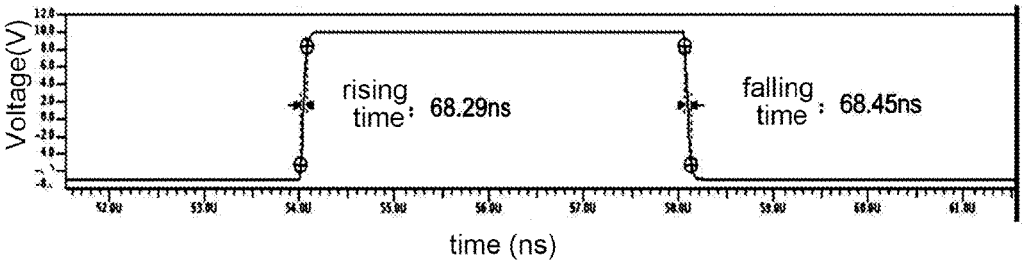

FIGS. 9A to 9C are graphs showing the transition time values of the clock signal at nodeN3 according to an embodiment of the present disclosure. Wherein FIG. 9A and FIG. 9B show the transition time values of the clock signal at node N3 in the unilateral driving method. The size of the first control subunit 120 or the second control subunit 140 corresponding to FIG. 9A is larger than that of the first control subunit 120 or the second control subunit 140 corresponding to FIG. 9B. For example, the size of the first control subunit 120 or the second control subunit 140 corresponding to FIG. 9A is 20 μm (micron) while the size of the first control subunit 120 or the second control subunit 140 corresponding to FIG. 9B is 1 μm. As can be seen from FIGS. 9A and 9B, the clock signal in FIG. 9A has a rise time of 281.8 ns and a fall time of 207.85 ns and the clock signal in FIG. 9B has a rise time of 159.08 ns and for a fall time of 158.31 ns. In this way, if the driving method is identical, the larger the size of the control unit is, the larger the transition time value is. In this way, both the delayed value of the clock signal and the value of electromagnetic interference can be adjusted by adjusting the size of the first control subunit and the second control subunit. As the transition time value of the clock signal in the unilateral driving method is relatively large, electromagnetic interference is not prone to be occurred in the unilateral driving method. FIG. 9C shows the transition time value of the clock signal at node N3 in the bilateral driving method. In this case, the transition time value of the clock signal is relatively small which has a rise time of 68.45 ns and a fall time of 68.3 ns. As the driving capability of the bilateral driving is relatively strong, a relatively small transition time value (i.e., fast transitions) will be obtained resulting in the occurrence of electromagnetic interference.

In this way, the transition time value of the clock signal at nodes in a unilateral driving circuit and in a bilateral driving circuit sufficiently illustrates that the value of electromagnetic interference in the unilateral driving circuit is relatively smaller than that in the bilateral driving circuit. Furthermore, the value of electromagnetic interference of the circuit can also be changed by adjusting the clock signal of the control unit.

According to the driving circuit of the display device provided in the embodiment of the present disclosure, by adding two control units between the timing driving circuit and each of two source driving circuits and disposing the control signal lines of the control unit on the external flexible circuit board, the driving method of the CHK signal is easily and conveniently switched by the external flexible circuit board to be either a unilateral driving method or a bilateral driving method.

Figure 10:
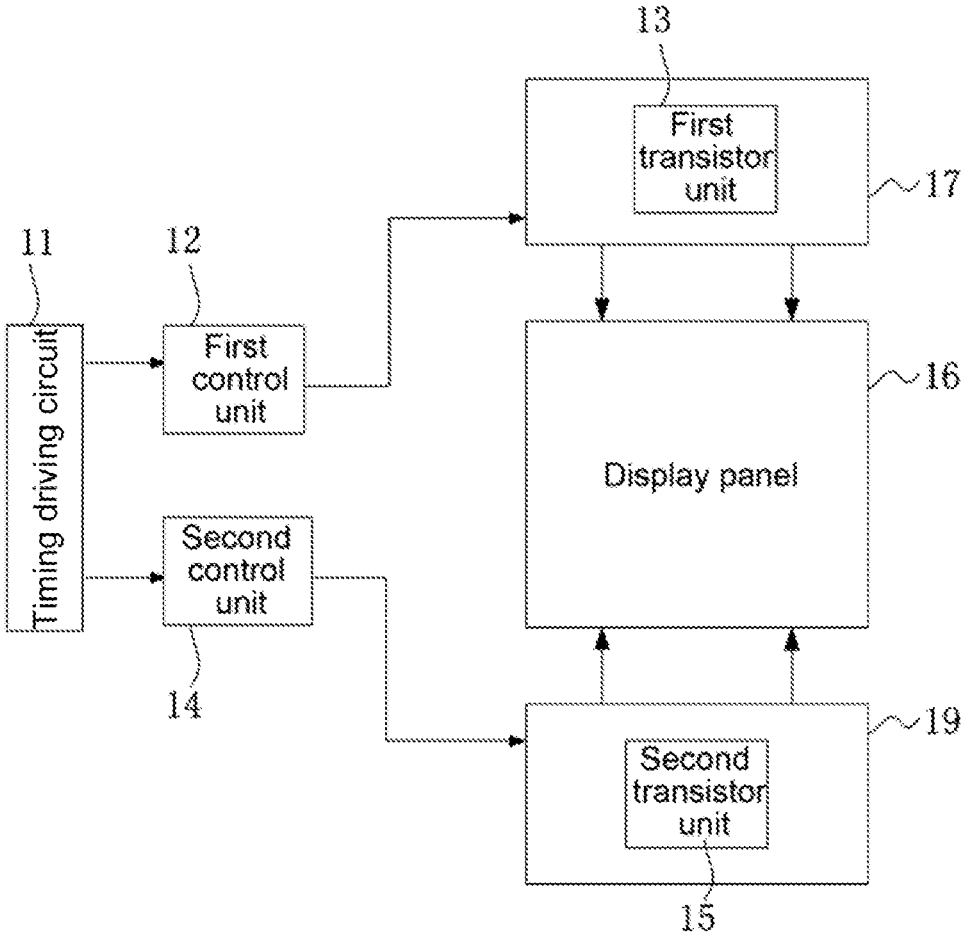
FIG. 10 is a schematic diagram of a driving circuit with unilateral-bilateral driving switching according to an embodiment of the present disclosure.
Figure 11:
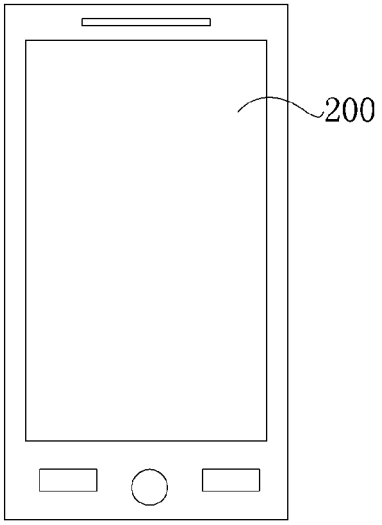
FIG. 11 is a schematic view of the display device with unilateral-bilateral driving switching according to an embodiment of the present disclosure.

The embodiment of the present disclosure also provides a display device including the driving circuit according to any embodiment of the present disclosure, FIG. 10 shows a driving circuit of the display device with a switched unilateral-bilateral driving according to an embodiment of the present disclosure. FIG. 11 a schematic view showing a driving circuit of the display device with unilateral-bilateral driving switching according to an embodiment of the present disclosure. As shown in FIG. 10, the display device includes a timing driving circuit 11, a first control unit 12, a second control unit 14, a first source driving circuit 17, a second source driving circuit 19, a gate driving circuit (not shown) and a display device 16. The first source driving circuit 17 includes a first transistor unit 13 and the second source driving circuit 19 includes a second transistor unit 15, wherein the timing driving circuit 11 and the first control unit 12 are connected with the first transistor unit 13, and the timing driving circuit 11 and the second control unit 14 are connected with the second transistor unit 15. Pixel units in the display device 16 are driven by the first source driving circuit 17 and the second source driving circuit 19 from the top side and the bottom side of the display device 16 respectively. Alternatively, each of a first control signal line and a second control signal line is disposed on an external flexible circuit board. FIG. 11 is a schematic view showing a display device 200 with unilateral-bilateral driving switching. As shown in FIG. 11, the display device 200 includes a display device according to any embodiment of the present disclosure and also includes a flexible circuit board (not shown).

Figure 12:
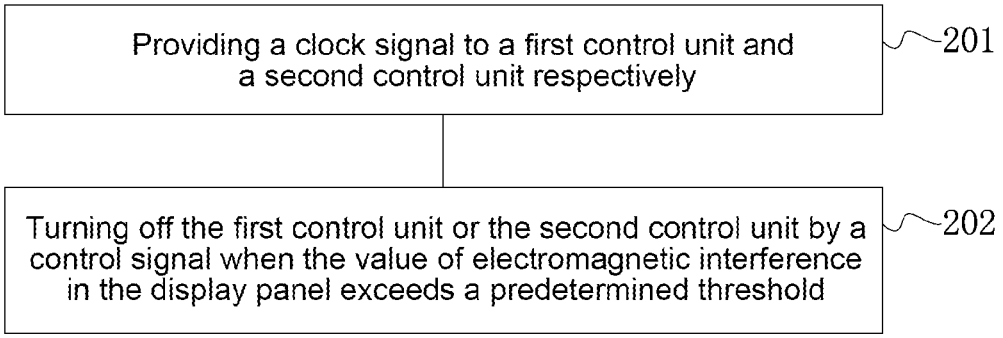
FIG. 12 is a flow chart showing a driving method for a display device according to an embodiment of the present disclosure.

An embodiment of the present disclosure also provides a method for driving a display device in order to facilitate unilateral-bilateral driving switching of a clock signal in driving circuit in the embodiment of the present disclosure. FIG. 12 is a flow chart showing a driving method for the display device according to an embodiment of the present disclosure. The driving method includes:

Step 201, providing a clock signal to a first control unit and a second control unit, respectively.

A timing driving circuit provides the clock signal to the first control unit and the second control unit, respectively. When the driving method in the embodiment is used to reduce the problem of degraded quality of the image caused by electromagnetic interference in the display device, the clock signal is a CKH signal.

Step 202, turning off the first control unit or the second control unit by a control signal when the value of electromagnetic interference in the display device exceeds a predetermined electromagnetic interference threshold value.

After the display device is sealed, the value of electromagnetic interference inside the display device will be measured so as to select a proper driving method for the display device based thereon. When the display device is operated under different working conditions, the value of electromagnetic interference varies. If the display device is operating in a specific condition and the value of electromagnetic interference inside the display device exceeds the predetermined electromagnetic interference threshold value, the driving method of the clock signal is switched to a unilateral driving method.

Particularly, when the value of electromagnetic interference caused by the clock signal of the first control unit to the display device is larger than the value of electromagnetic interference caused by the clock signal of the second control unit to the display device, the first control unit is turned off. When the value of electromagnetic interference caused by the clock signal of the second control unit to the display device is larger than the value of electromagnetic interference caused by the clock signal of the first control unit to the display device, the second control unit is turned off. For example, where there is a speaker or an electrical line adjacent to the first source driving circuit, the value of electromagnetic interference in the display device caused by the first source driving circuit is larger than the value of electromagnetic interference value in the display device caused by the second source driving circuit, the first control unit should be turned off at this time. Or, when the first control unit and the second control unit are in the same environment and it is difficult to determine which one should be turned off, the first control unit and the second control unit are separately turned off, and the value of electromagnetic interference in the display device is measured each time. The driving method with a relatively small value of electromagnetic interference will be selected, i.e., the control unit corresponding to a relatively small value of electromagnetic interference is turned on and the control unit corresponding to a relatively large value of electromagnetic interference is turned off.

In an exemplary embodiment, when the control subunit includes a transfer gate and an inverter, if a gate of P-type thin film field effect transistor directly receives a control signal, the control unit corresponding to the control signal is turned on when the control signal is in high level and the control unit corresponding to the control signal is turned off when the control signal is in low level. If a gate of N-type thin film field effect transistor directly receives the control signal, the control unit corresponding to the control signal is turned off when the control signal is in high level and the control unit corresponding to the control signal is turned on when the control signal is low-level.

According to the driving switching method provided by the embodiment of the present disclosure, it is capable of utilizing the driving circuit according to any embodiment of the present disclosure to switch the driving method of the clock signal to a unilateral driving method or to a bilateral driving method. According to the driving switching method of the embodiment of the present disclosure, as turning on or off of the first control unit and the second control unit can be achieved only by the control signal received by the first control signal line and the second control signal line provided on the external flexible circuit board, the driving method for the clock signal can be controlled by altering the external flexible circuit board.

As can be appreciated, the embodiments described above are not exhaustive descriptions of all embodiments of the present disclosure. Although specific embodiments of the present disclosure are described, the disclosure is not limited to these embodiments. Various modifications and variations may be made on the technical solutions of the present disclosure by those skilled in the art in light of the methods and circuits, and other technical contents described above without departing from the scope of the disclosure, or equivalent embodiments with equivalent modifications may be obtained. In this way, any simple modifications, equivalent variations and modifications made to the embodiments based on the essence of the technical solution without departing the scope of the technical solutions of the present disclosure are intended to fall within the scope of this disclosure.

What is claimed is:

1. A driving circuit for a display device including a plurality of pixel units, comprising:

a first source driving circuit and a second source driving circuit;

a first control unit comprising a plurality of first control subunits, each of the first control subunits comprising a control end, an input end, and an output end, the control end of the first control subunit configured to receive a first control signal to tum on or off the first control subunit, the input end of the first control subunit configured to receive a first clock signal, and the output end of the first control subunit being connected with the first source driving circuit; and a second control unit comprising a plurality of second control subunits, each of the second control subunits comprising a control end, an input end and an output end, the control end of the second control subunit configured to receive a second control signal to tum on or off the second control subunit, the input end of the second control subunit configured to receive a second clock signal, and the output end of the second control subunit being connected with the second source driving circuit, wherein the plurality of pixel units included in the display device are all driven by the first source driving circuit and the second source driving circuit, and when a value of electromagnetic interference in the display device exceeds a predetermined threshold value, one of the first control unit connected to the first source driving circuit and the second control unit connected to the second source driving circuit, is configured to be turned off.

2. The driving circuit of claim 1, wherein:

the first source driving circuit comprises a first transistor unit comprising a plurality of transistors, wherein a drain of each transistor of the first transistor unit is connected to a source of a transistor of a corresponding pixel unit, a source of each transistor of the first transistor unit is configured to receive a source driving signal for the transistor of the corresponding pixel unit, and a gate of each transistor of the first transistor unit is configured to receive a clock signal from an output end of a corresponding first control subunit; and the second source driving circuit comprises a second transistor unit comprising a plurality of transistors, wherein a drain of each transistor of the second transistor unit is connected to a source of a transistor of a corresponding pixel unit, a source of each transistor of the second transistor unit is configured to receive a source driving signal for the transistor of the corresponding pixel unit and a gate of each transistor of the second transistor unit is configured to receive a clock signal from an output end of a corresponding second control subunit.

3. The driving circuit of claim 1, wherein each of the first control subunit and the second control subunit comprises a transfer gate and an inverter, and the transfer gate is a complementary metal oxide semiconductor comprising an N-type thin film field effect transistor and a P-type thin film field effect transistor, wherein, an input end of each of the first control subunit and the second control subunit is electrically connected with a source of the N-type thin film field effect transistor and a drain of the P-type thin film field effect transistor;

an output end of each of the first control subunit and the second control subunit is electrically connected with a drain of the N-type thin film field effect transistor and a source of the P-type thin film field effect transistor;

a gate of the P-type thin film field effect transistor is configured to directly receive the first or second control signal, an input end of the inverter is configured to receive the first or second control signal and an output end of the inverter is connected to a gate of the N-type thin film field effect transistor, or, the gate of the N-type thin film field effect transistor is configured to directly receive the first or second control signal, the input end of the inverter is configured to receive the first or second control signal and the output end of the inverter is connected to the gate of the P-type thin film field effect transistor.

4. The driving circuit of claim 1, wherein the display device comprises a circuit board, the control end of each of the plurality of first control subunits of the first control unit is connected to a first control signal line disposed on the circuit board, the control end of each of the plurality of second control subunits of the second control unit is connected to a second control signal line disposed on the circuit board, and the first control signal line and the second control signal line receive a control signal separately.

5. The driving circuit of claim 1, further comprises a timing driving circuit configured to provide the first and second clock signals.

6. The driving circuit of claim 5, wherein the display device comprises a display area and a non-display area located in a periphery of the display area, and the first and second control units are disposed in the non-display area of the display device.

7. The driving circuit of claim 1, wherein the control ends of the plurality of the first control subunits of the first control unit are electrically connected with each other, and the control ends of the plurality of the second control subunits of the second control unit are electrically connected with each other.

8. A display device comprising a driving circuit and a plurality of pixel units, the driving circuit comprising:

a first source driving circuit and a second source driving circuit;

a first control unit comprising a plurality of first control subunits, each of the first control subunits comprising a control end, an input end, and an output end, the control end of the first control subunit configured to receive a first control signal to tum on or off the first control subunit, the input end of the first control subunit configured to receive a first clock signal, and the output end of the first control subunit being connected with the first source driving circuit; and a second control unit comprising a plurality of second control subunits, each of the second control subunits comprising a control end, an input end and an output end, the control end of the second control subunit configured to receive a second control signal to tum on or off the second control subunit, the input end of the second control subunit configured to receive a second clock signal, and the output end of the second control subunit being connected with the second source driving circuit, wherein the plurality of pixel units included in the display device are all driven by the first source driving circuit and the second source driving circuit, and when a value of electromagnetic interference in the display device exceeds a predetermined threshold value, one of the first control unit connected to the first source driving circuit and the second control unit connected to the second source driving circuit, is configured to be turned off.

9. A method for driving a display device comprising a driving circuit and a plurality of pixel units, the driving circuit comprising:

a first source driving circuit and a second source driving circuit, wherein the plurality of pixel units included in the display device are all driven by the first source driving circuit and the second source driving circuit;

a first control unit comprising a plurality of first control subunits, each of the first control subunits comprising a control end, an input end, and an output end, the control end of the first control subunit configured to receive a first control signal to tum on or off the first control subunit, the input end of the first control subunit configured to receive a first clock signal, and the output end of the first control subunit being connected with the first source driving circuit; and a second control unit comprising a plurality of second control subunits, each of the second control subunits comprising a control end, an input end and an output end, the control end of the second control subunit configured to receive a second control signal to tum on or off the second control subunit, the input end of the second control subunit configured to receive a second clock signal, and the output end of the second control subunit being connected with the second source driving circuit;

the method comprising:

providing the first clock signal to the first control unit;

providing the second clock signal to the second control unit;

turning off the first control unit or turning off the second control unit by a control signal when a value of electromagnetic interference in the display device exceeds a predetermined threshold value.

10. The method of claim 9, wherein turning off the first control unit or turning off the second control unit by the control signal comprises:

turning off the first control unit when a value of electromagnetic interference caused by the first clock signal of the first control unit on the display device is greater than a value of electromagnetic interference caused by the second clock signal of the second control unit to the display device; and turning off the second control unit when the value of electromagnetic interference caused by the clock signal of the second control unit to the display device is greater than the value of electromagnetic interference caused by the clock signal of the first control unit to the display device.

11. The method of claim 9, wherein, when each of the first control subunit and the second control subunit comprises a transfer gate and an inverter, if the gate of the P-type thin film field effect transistor directly receives the control signal, turning on the first or second control unit corresponding to the first or second control signal when the first or second control signal is a high level signal, and turning off the first or second control unit corresponding to the first or second control signal when the control signal is a low level signal;

if the gate of the N-type thin film field effect transistor directly receives the control signal, turning off the first or second control unit corresponding to the first or second control signal when the first or second control signal is a high level signal, and turning on the first or second control unit corresponding to the first or second control signal when the control signal is a low level signal.

* * * * *